US006924598B2

(12) United States Patent
Strattman

(10) Patent No.: US 6,924,598 B2
(45) Date of Patent: Aug. 2, 2005

(54) APPARATUS FOR PROVIDING A KINETIC LIGHTNING EFFECT

(76) Inventor: Wayne Strattman, 199 W. Newton St., Boston, MA (US) 02116

( * ) Notice: Subject to any disclaimer, the term of this patent is extended or adjusted under 35 U.S.C. 154(b) by 104 days.

(21) Appl. No.: 10/428,389

(22) Filed: May 2, 2003

(65) Prior Publication Data

US 2004/0217709 A1 Nov. 4, 2004

(51) Int. Cl.[7] ..... H01J 61/02

(52) U.S. Cl. ..... 313/609; 313/607; 313/611; 313/634; 313/637; 313/25; 313/26; 40/406; 40/407; 368/93; 362/96; 362/98; 362/101; 362/318; 315/326; 315/329

(58) Field of Search ..... 313/609, 607, 313/611, 634, 637, 643; 362/101, 96, 98, 318; 40/406, 407; 368/93; 315/326–329

(56) References Cited

U.S. PATENT DOCUMENTS

| | | | | | |
|---|---|---|---|---|---|
| 1,851,532 | A | * | 3/1932 | Vollrath | 313/608 |
| 2,043,925 | A | | 6/1936 | Epstein | 176/14 |
| 2,135,480 | A | | 11/1938 | Birdseye | 176/124 |
| 2,520,691 | A | | 8/1950 | Otis | 240/10 |
| 2,644,890 | A | | 7/1953 | Hollihan | 250/71 |
| D198,268 | S | | 5/1964 | Thorington et al. | D26/8 |
| 4,072,855 | A | | 2/1978 | Marchese | 362/101 |
| 4,267,588 | A | | 5/1981 | Daniels | 368/93 |
| 4,474,481 | A | | 10/1984 | Croyle | 368/93 |
| D294,069 | S | | 2/1988 | Morrison | D26/93 |
| 4,754,199 | A | | 6/1988 | Parker | 315/85 |
| 4,942,504 | A | * | 7/1990 | Brotz | 362/84 |
| D322,489 | S | | 12/1991 | Parker | D26/104 |
| 5,122,994 | A | | 6/1992 | Benedetti | 368/93 |
| 5,528,561 | A | | 6/1996 | Castanis | 368/93 |
| 5,678,918 | A | | 10/1997 | Lin | 362/96 |
| D420,603 | S | | 2/2000 | Morga | D10/44 |
| D429,839 | S | | 8/2000 | Ling | D26/104 |
| 6,206,536 | B1 | | 3/2001 | Lin | 362/101 |

FOREIGN PATENT DOCUMENTS

| | | | | |
|---|---|---|---|---|
| JP | 57128447 A | * | 8/1982 | H01J/61/30 |
| JP | 58-150882 | | 9/1983 | G04F/3/00 |
| JP | 58-150883 | | 9/1983 | G04F/3/00 |
| JP | 58-150884 | | 9/1983 | G04F/3/00 |

* cited by examiner

*Primary Examiner*—Ashok Patel
*Assistant Examiner*—Sikha Roy
(74) *Attorney, Agent, or Firm*—Peter A. Nieves, Esq.; Hayes Soloway P.C.

(57) ABSTRACT

An apparatus for providing a visual lightning effect includes a first chamber and a second chamber, where a passageway connects the first chamber and the second chamber. An inert gas is provided within the first chamber, the second chamber, and the passageway. A first contact is located external to the first chamber; and a second contact is located external to the second chamber, wherein an electrode provides a charge to the second contact, wherein the charge causes an electrical discharge between the second contact and the first contact via channels provided by fill material located within the second chamber that traverses the passageway to the first chamber, thereby resulting in the brilliant visual lightning effect.

20 Claims, 4 Drawing Sheets

APPARATUS FOR PROVIDING A KINETIC LIGHTNING EFFECT

FIELD OF THE INVENTION

The present invention generally relates to entertainment devices and, more particularly, is related to the display of light.

BACKGROUND OF THE INVENTION

With the advancement of technology it has become well known that excitement of atoms of certain gases results in the display of light. In fact, the excitement of certain classifications of gases has been shown to result in the display of specific colors of light that may be used for specific purposes. As an example, the process of exciting atoms of neon is known to result in a colorful display of light. Specifically, knowledge of the physics and chemistry of electrically generated gaseous discharges has led to the commercially significant development of devices such as neon signs and fluorescent lamps.

There are common elements among devices that provide the display of light. As an example, these elements may include a gaseous environment stored within a vessel and an energy source capable of exciting atoms of the gas located within the vessel. While these fundamental elements are a commonality in most devices that display light, the elements may be used in collaboration with other elements to provide many other visually appealing displays of light. In fact, while the above-mentioned devices have practical applications, examples of which have been mentioned above, the above elements may be used in devices to provide decorative visual displays that are aesthetically pleasing.

SUMMARY OF THE INVENTION

In light of the foregoing, the invention generally relates to an apparatus for providing a visual lightning effect.

Generally, with reference to the structure of the apparatus, the apparatus contains a first chamber and a second chamber, where a passageway connects the first chamber and the second chamber. An inert gas is provided within the first chamber, the second chamber, and the passageway. A first contact is located external to the first chamber; and a second contact is located external to the second chamber, wherein an electrode provides a charge to the second contact, wherein the charge causes an electrical discharge between the second contact and the first contact, resulting in the visual lightning effect.

Other objects, features, and advantages of the present invention will become apparent upon reading and understanding the present specification, when taken in conjunction with the accompanying drawings.

BRIEF DESCRIPTION OF THE DRAWINGS

The invention can be better understood with reference to the following drawings. The components of the drawings are not necessarily to scale, emphasis instead being placed upon clearly illustrating the principles of the present invention. Moreover, in the drawings, like referenced numerals designate corresponding parts throughout the several views.

DETAILED DESCRIPTION

The present invention is an ornamental entertainment device that provides a kinetic lightning effect that is visually appealing. It should be noted that, while the following provides a series of examples of the entertainment device, other configurations may be utilized as well.

Figure 1:
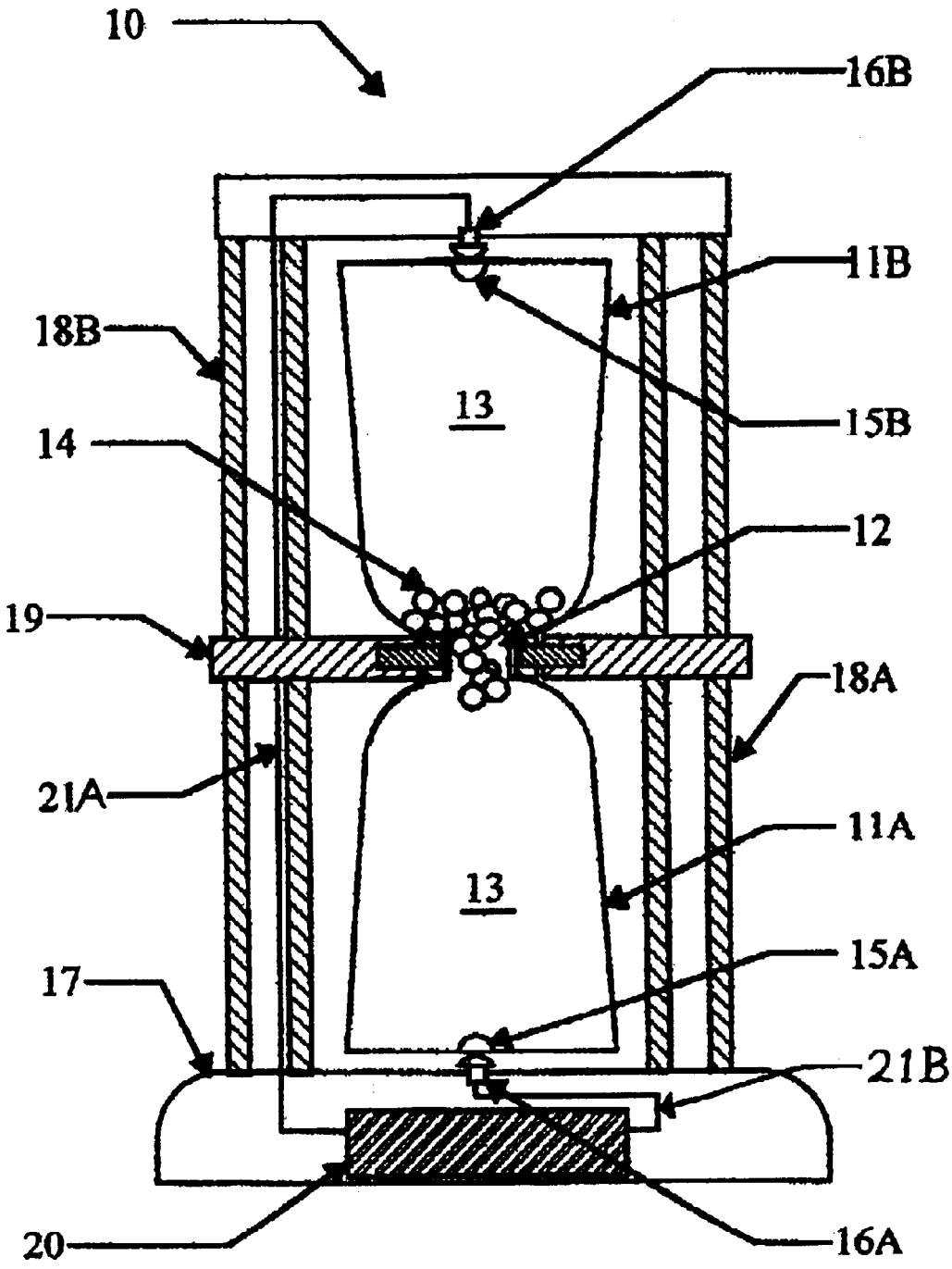
FIG. 1 is a schematic diagram that provides a cross-sectional illustration of the present ornamental device in accordance with a first exemplary embodiment of the invention.

FIG. 1 is a schematic diagram that provides a cross-sectional illustration of the present ornamental device 10 in accordance with a first exemplary embodiment of the invention. As shown by FIG. 1, the ornamental device 10 contains a first translucent chamber 11A and a second translucent chamber 11B. It should be noted that the translucent chambers 11A, 11B may be made of glass or any other suitable non-conductive material.

The translucent chambers 11A, 11B are connected via a common passageway 12. It should be noted that the passageway 12 need not be centrally located between the chambers 11A, 11B. As is shown by FIG. 1, diameter of the passageway 12 is smaller than diameter of either the first translucent chamber 11A or the second translucent chamber 11B and provides an opening between the chambers 11A, 11B. While the combination of the translucent chambers 11A, 11B and the passageway 12 provides the ornamental device 10 in a shape that resembles an hourglass, one having ordinary skill in the art will appreciate that the ornamental device 10 need not be in the shape of an hourglass. In fact, the chambers 11A, 11B may be of different sizes and shapes.

The chambers 11A, 11B, and the passageway 12 located therebetween, are filled with an inert gas. It should be noted that the translucent chambers 11A, 11B and passageway 12 provide an airtight environment so that the inert gas remains within the chambers 11A, 11B and passageway 12. Examples of inert gases that may be utilized include, but are not limited to, Argon, Neon, Xenon, and Krypton. In addition, Mercury vapor may be utilized. In fact, it should be noted that other gases that are not inert, and that would provide a similar discharge visual lightning effect, as described below, may instead be used.

A granular fill material 14, such as, but not limited to, glass beads, is located within the chambers 11A, 11B and the passageway 12. It should be noted that a different solid non-conductive material may be utilized instead of the glass beads. In fact, glass beads are utilized in accordance with the first exemplary embodiment of the invention due to the capability of seeing light clearly through the beads. In addition, as is described in detail below, the granular fill material 14 acts as a means to squeeze a discharge within the chambers 11A, 11B and the passageway 12 through randomly changing channels provided by the granular fill material 14, in addition to, in one embodiment, movement of the fill material 14, thereby resulting in a bright lightning effect. Alternatively, the granular fill material 14 may be conductive.

The first chamber 11A contains a first contact 15A that is partially located within a first end of the first chamber 11A, wherein the first end of the first chamber 11A is located opposite the passageway 12, and partially located external to the first chamber 11A. Alternatively, the second chamber 11B contains a second contact 15B that is partially located within a first end of the second chamber 11B, wherein the first end of the second chamber 11B is located opposite the passageway 12, and partially located external to the second chamber 11B. The first contact 15A and the second contact 15B are fabricated from a conducting material that will allow the receipt of an electrical charge (i.e., voltage), as is described below.

In accordance with the first exemplary embodiment of the invention, the chambers 11A, 11B and the passageway 12 are held by a non-conductive housing containing a base 17, a first vertical support channel 18A, a second vertical support channel 18B, and an axel and clamp assembly 19. The base 17 further contains a power source 20, which is capable of providing a voltage to either of a first electrode 16A, or a second electrode 16B, both of which are partially located within the chambers 11A, 11B. In addition, the power source 20 provides a ground that is connected to either the first electrode 16A, or the second electrode 16B. It should be noted that the power source 20 may alternatively be located external to the base 17, or connected to the base 17.

The power supply 20 may be an alternating current (AC) power supply and/or a direct current (DC) power supply and can be provided in numerous known configurations. In accordance with the first exemplary embodiment of the invention, the power supply 20 is an AC power supply and contains circuitry specifically designed to deliver a proper electrical potential required to excite the inert gas contained in the chambers 11A, 11B and passageway 12 as it travels from one electrode (source) to the opposite (ground) electrode. Alternatively, the power supply 20 may also be configured as a DC power supply utilizing one or more batteries that may be rechargeable or non-rechargeable. In addition, the power supply 20 may be provided using AC to DC circuitry capable of proving the desired charge and ground.

The power source 20 is connected to the second electrode 16B via first wiring 21A, which, as is shown by FIG. 1, traverses an interior portion of the second vertical support channel 18B. It should be noted that the first wiring 21A may instead connect to the second electrode 16B after traversing an interior portion of the first vertical support channel 18A. The power source 20 is also connected to the first electrode 16A via second wiring 21B.

When a central axis of the first chamber 11A, the second chamber 11B, and the passageway 12 is aligned in a vertical position, the first electrode 16A is removably connected to the first contact 15A, and the second electrode 16B is removably connected to the second contact 15B. Connection between the first electrode 16A and the first contact 15A provides an electrical connection that allows a charge originating from the power source 20 to reach the first contact 15A. In addition, connection between the second electrode 16B and the second contact 15B is an electrical connection that allows a charge originating from the power source 20 to reach the second contact 15B. It should be noted that a portion of the power source 20 may also provide a ground that is connected to either the first electrode 16A or the second electrode 16B. Therefore, as an example, if a ground is provided by the power source 20, via second wiring 21B, to the first electrode 16A, the first contact 15A is the ground.

In accordance with the first exemplary embodiment of the invention, the first wiring 21A is provided with a voltage from the power source 20, and the second wiring 21B is connected to a ground of the power source 20, a charge is emitted from the power source 20, traverses the first wiring 21A, enters the second electrode 16B, traverses to the second contact 15B, and travels through the second chamber 11B, through the passageway 12, and through the first chamber 11A to the first contact 15A, which serves as ground.

The discharge through the chambers 11A, 11B and passageway 12 travels through the inert gas 13 and the granular fill material 14 causing the gas to glow and produce a kinetic, thin, bright lightning effect that is visually appealing to the user. The granular fill material 14 restricts electrical discharge as the charge passes from the second contact 15B to the first contact 15A making the lightning effect more dramatic. Specifically, the electrical discharge passing from the second contact 15B to the first contact 15A is forced to squeeze through randomly changing chambers located between the granular fill material 14 resulting in a bright lightning effect. Movement of the granular fill material 14 between chambers 11A, 11B, preferably due to gravity, although other means of moving the fill material 14 may be utilized, results in the chambers between the granular fill material 14 constantly changing.

It should be noted that, as the granular fill material 14 falls from one chamber 11A, 11B to the other chamber 11A, 11B, the lightening effect may be visually intensified by reflection of the electrical discharge by the granular fill material 14. In addition, if the granular fill material 14 is glass beads, the beads tend to amplify the lightening effect since light can be seen through the glass beads. Further, as the beads fall from one chamber 11A, 11B to the other chamber 11A, 11B, depending on composition of the beads, the beads may make a soothing sound.

Once the granular fill material 14 has migrated from the second chamber 11B, through the passageway 12, to the first chamber 11A, the chambers 11A, 11B may be rotated about the axis 19, allowing the granular fill material 14 to flow from the second chamber 11B to the first chamber 11A. In addition, when the first contact 15A is aligned with the second electrode 16B, and the second contact 15B is aligned with the first electrode 16A, a discharge is again produced, thereby once again producing the kinetic, thin, and bright lightning effect.

It should be noted that, due to the use of granular fill material within the hourglass-like shape, the ornamental device 10 may also be used as a timer, even though the ability of the ornamental device to function as a timer is secondary to providing appealing visual effects. The ornamental device 10 may be produced in several configurations and is not limited to the aforementioned embodiments described herein.

Figure 2:
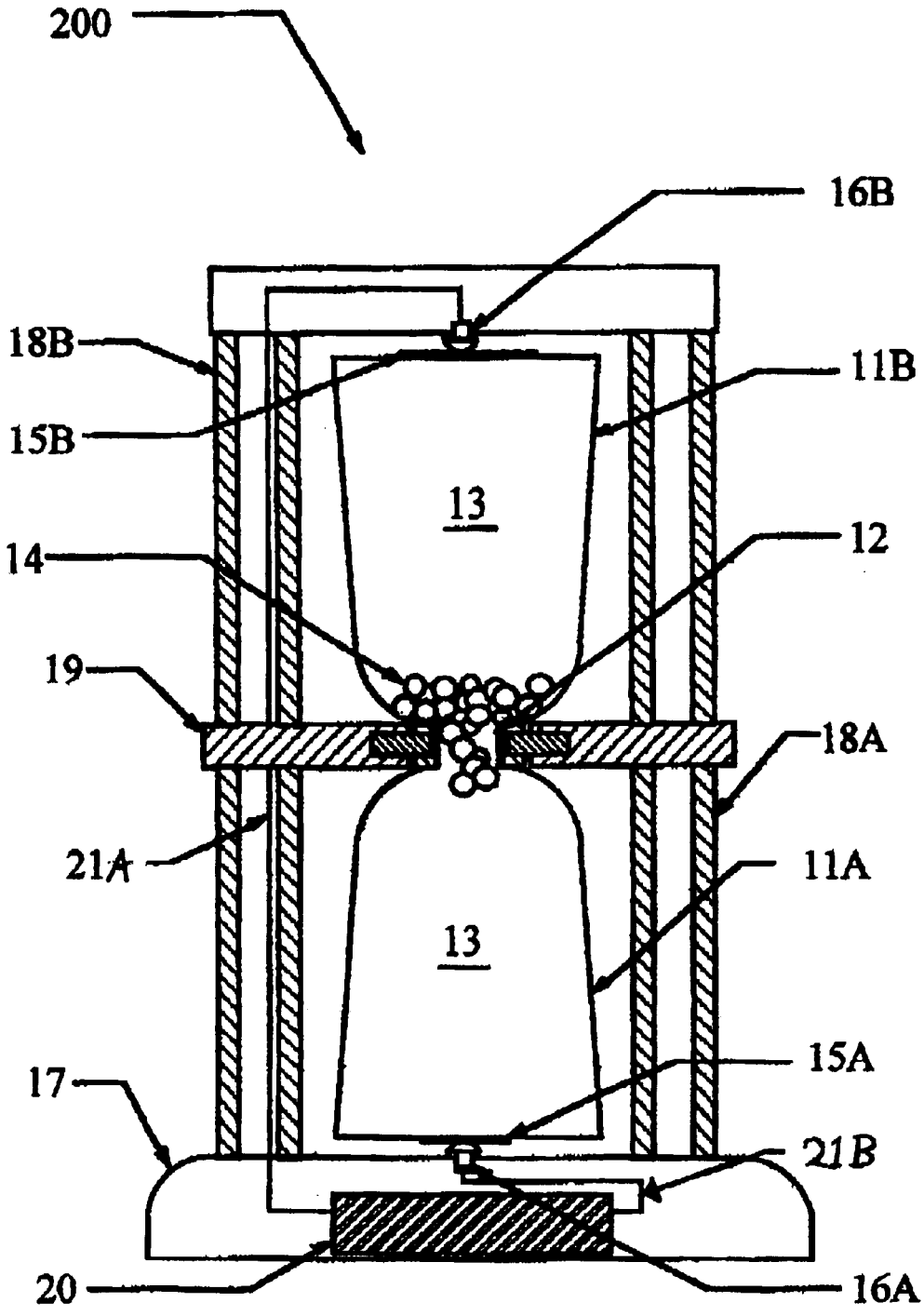
FIG. 2 is a schematic diagram that provides a cross-sectional illustration of the present ornamental device in accordance with a second exemplary embodiment of the invention.

FIG. 2 is a schematic diagram that provides a cross-sectional illustration of the present ornamental device 200, in accordance with a second exemplary embodiment of the invention. As is shown by FIG. 2, the ornamental device 200 of the second exemplary embodiment of the invention differs from the ornamental device 10 of the first exemplary embodiment of the invention by location of the electrodes 16A, 16B and location of the contacts 15A, 15B, which are required to deliver the charge to the gas 13 contained within the chambers 11A, 11B.

As is shown by FIG. 2, contacts 15A, 15B and electrodes 16A, 16B are located external to the chambers 11A, 11B and therefore, do not require openings in the chambers 11A, 11B to accommodate the contact 15A, 15B.

In accordance with the second exemplary embodiment of the invention, the contacts 15A, 15B are disposed external to the chambers 11A, 11B. Preferably, the first contact 15A is sealed to the first end of the first chamber 11A and the second contact 15B is sealed to the first end of the second chamber 11B. Therefore, when the ornamental device 10 is aligned vertically, the electrodes 16A, 16B connect to the contacts 15A, 15B, thereby allowing the charge to travel from the second electrode 16B, to the second contact 15B, through the inert gas 13, to the first contact 15A, and to the first electrode 16B.

Figure 3:
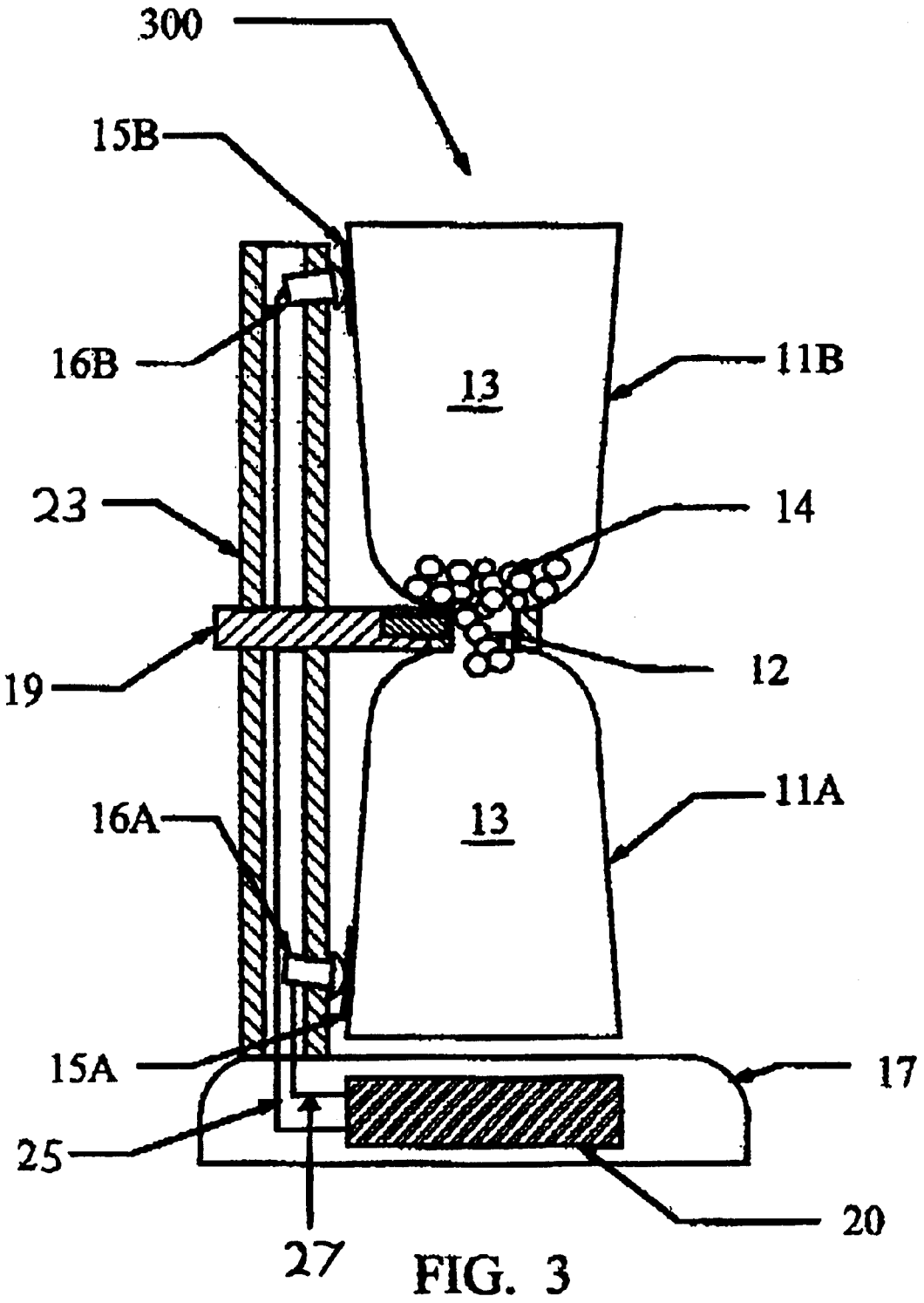
FIG. 3 is a schematic diagram that provides a cross-sectional illustration of the present ornamental device in accordance with a third exemplary embodiment of the invention.

FIG. 3 is a schematic diagram that provides a cross-sectional illustration of the present ornamental device 300 in accordance with a third exemplary embodiment of the invention. As is shown by FIG. 3, the first contact 15A is situated on a side of the first chamber 11A and the second contact 15B is situated on a side of the second chamber 11B. In addition, the electrodes 16A, 16B are partially located within a vertical support channel 23, wherein a first wire 25 traverses the channel 23 to the second electrode 16B and a second wire 27 traverses the channel 23 to the first electrode 16A.

It should be noted that when the ornamental device 300 is vertically aligned, the first electrode 16A meets the first contact 15A and the second electrode 16B meets the second contact 15B. Alternatively, the contacts 15A, 15B may be partially located within the chambers 11A, 11B as described above with reference to FIG. 1.

Figure 4:
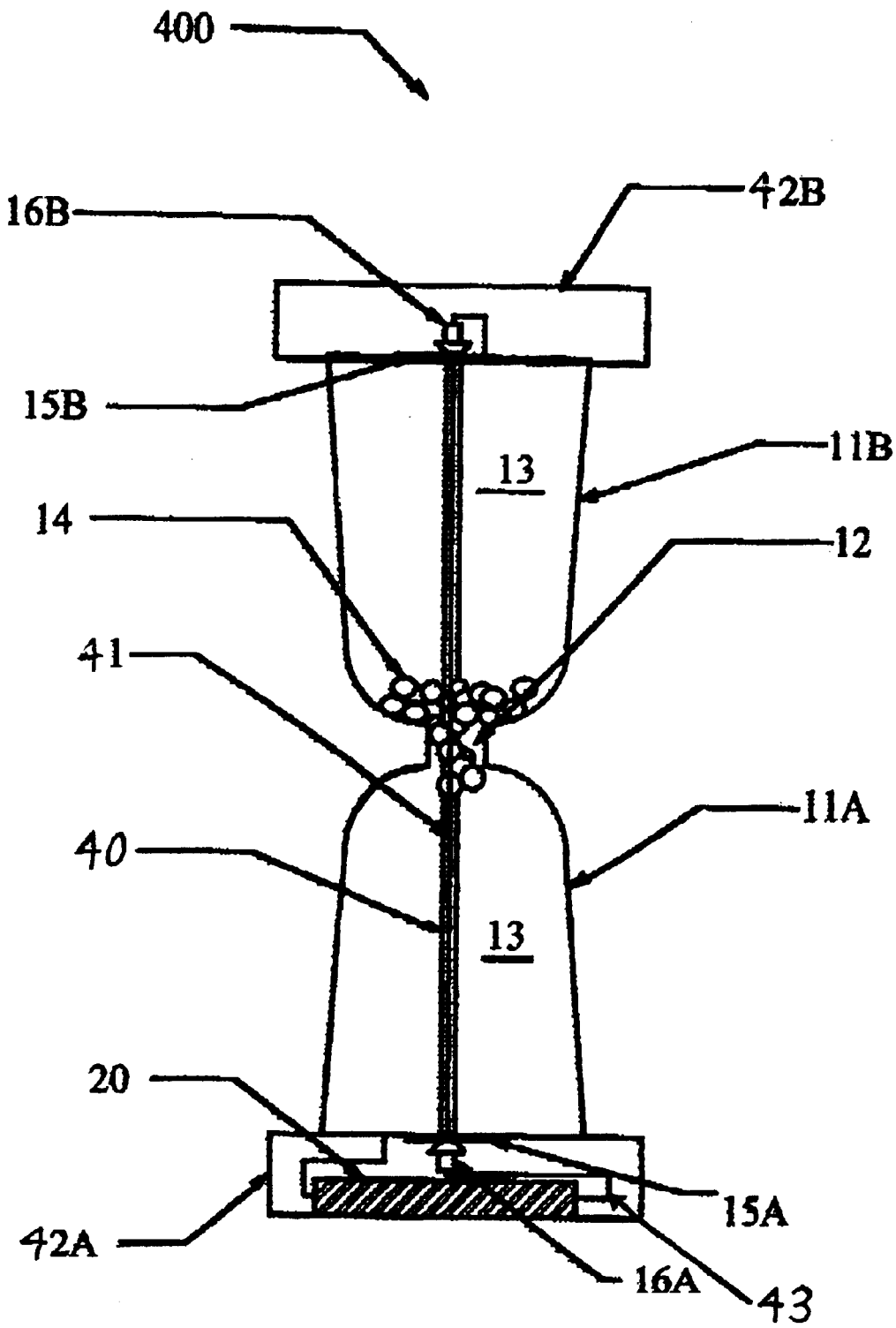
FIG. 4 is a schematic diagram that provides a cross-sectional illustration of the present ornamental device in accordance with a fourth exemplary embodiment of the invention.

FIG. 4 is a schematic diagram that provides a cross-sectional illustration of the present ornamental device 400 in accordance with a fourth exemplary embodiment of the invention. As is shown by FIG. 4, the ornamental device 400 is self-contained and does not require a housing as is required by the previously described embodiments.

In accordance with the fourth exemplary embodiment, the first chamber 11A, the second chamber 11B, and the passageway 12 contain a conduit 40 therein. The first electrode 16A is located within a first end-cap 42A and the second electrode 16B is located within a second end cap 42B. Preferably the end caps 42A, 42B are situated on ends of the chambers 11A, 11B.

The conduit 40 contains a first wire 41, which connects a power terminal of the power supply 20 to the second electrode 16B. In addition, a second wire 43 connects a ground terminal of the power supply 20 to the first electrode 16A. Therefore, a charge provided to the second electrode 16B traverses the second chamber 11B, the passageway 12, and the first chamber 11A to the first electrode 16A, resulting in excitement of the gas, and providing the kinetic, lightning effect. It should be noted that the first wire 41 may, alternatively, be adhered to an exterior of the ornamental device.

In accordance with a fifth exemplary embodiment of the invention, the granular fill material 14 is stationary and does not travel between chambers 11A, 11B. Therefore, the granular fill material 14 may partially or completely fill each chamber 11A, 11B, or just one chamber 11A, 11B. In accordance with this embodiment, the granular fill material 14 has holes therein allowing the discharge to traverse from the second contact to the first contact, via channels provided by the holes. It should be noted that the prior embodiments were more visually appealing due to randomly changing channels associated with granular fill material 14 movement.

It should be emphasized that the above-described embodiments of the present invention are merely possible examples of implementations, merely set forth for a clear understanding of the principles of the invention. Many variations and modifications may be made to the above-described embodiments of the invention without departing substantially from the spirit and principles of the invention. All such modifications and variations are intended to be included herein within the scope of this disclosure and the present invention, and protected by the following claims.

What is claimed is:

1. An apparatus for providing a visual lightning effect, comprising:

a first chamber;

a second chamber, wherein said first chamber and said second chamber are connected by a passageway, and wherein a gas is provided within said first chamber, said second chamber, and said passageway;

a first contact located external to said first chamber;

a second contact located external to said second chamber;

at least one electrode for providing a charge to said second contact, wherein said charge causes an electrical discharge between said second contact and said first contact, resulting in said visual lightning effect; and a fill material is located within said second chamber, wherein said fill material traverses said passageway to enter said first chamber, thereby restricting said electrical discharge as said charge passes from said second contact to said first contact, and wherein said passing of said electrical discharge from said second contact to said first contact is through channels located between said fill material.

2. The apparatus of claim 1, wherein a diameter of said passageway is smaller than a diameter of said first chamber.

3. The apparatus of claim 1, wherein said apparatus is in a shape of an hourglass.

4. The apparatus of claim 1, wherein said gas is an inert gas.

5. The apparatus of claim 1, wherein said gas is selected from the group consisting of Argon gas, Neon gas, Xenon gas, and Krypton gas.

6. The apparatus of claim 1, wherein said first contact is located on a first side of said first chamber that is located on a side opposite said passageway, and wherein said second contact is located on a first side of said second chamber that is located on a side opposite said passageway.

7. The apparatus of claim 1, wherein a second fill material is located within said second chamber, said second fill material being stationary within said second chamber, thereby restricting said electrical discharge as said charge passes from said second contact to said first contact, and wherein said passing of said electrical discharge from said second contact to said first contact is through holes located within said second fill material.

8. The apparatus of claim 1, wherein an amount of said fill material is predetermined such that said traversal of said fill material from said second chamber to said first chamber occurs in a predefined amount of time.

9. The apparatus of claim 1, further comprising a second electrode for providing a ground to said first contact.

10. An apparatus for providing a visual lightning effect, comprising:

a first chamber;

a second chamber, wherein said first chamber and said second chamber are connected by a passageway, and wherein a gas is provided within said first chamber, said second chamber, and said passageway;

a first contact partially located external to said first chamber;

a second contact partially located external to said second chamber;

at least one electrode for providing a charge to said second contact, wherein said charge causes an electrical discharge between said second contact and said first contact, resulting in said visual lightning effect; and a fill material is located within said second chamber, wherein said fill material traverses said passageway to fill said first chamber, thereby restricting said electrical discharge as said charge passes from said second contact to said first contact, and wherein said passing of said electrical discharge from said second contact to said first contact is through channels located between said fill material.

11. The apparatus of claim 10, wherein a diameter of said passageway is smaller than a diameter of said first chamber.

12. The apparatus of claim 10, wherein said apparatus is in a shape of an hourglass.

13. The apparatus of claim 10, wherein said gas is an inert gas.

14. The apparatus of claim 13, wherein said inert gas is selected from the group consisting of Argon gas, Neon gas, Xenon gas, and Krypton gas.

15. The apparatus of claim 10, wherein said first contact is located on a first side of said first chamber that is located on a side opposite said passageway, and wherein said second contact is located on a first side of said second chamber that is located on a side opposite said passageway.

16. The apparatus of claim 10, wherein a second fill material is located within said second chamber, said second fill material being stationary within said second chamber, thereby restricting said electrical discharge as said charge passes from said second contact to said first contact, and wherein said passing of said electrical discharge from said second contact to said first contact is through holes located within said second fill material.

17. The apparatus of claim 10, wherein an amount of said fill material is predetermined such that said traversal of said fill material from said second chamber to said first chamber occurs in a predefined amount of time.

18. The apparatus of claim 10, further comprising a second electrode for providing a ground to said first contact.

19. An apparatus for providing a visual lightning effect, comprising:

a first chamber;

a second chamber, wherein said first chamber and said second chamber are connected by a passageway, and wherein an inert gas is provided within said first chamber, said second chamber, and said passageway;

a fill material located within said second chamber and traversing said passageway to said first chamber; and at least one electrode for providing a charge to a top portion of said second chamber, wherein said charge causes an electrical discharge from said second chamber, through at least one channel formed by said fill material, to said first chamber, resulting in said visual lightning effect.

20. The apparatus of claim 19, wherein a diameter of said passageway is smaller than a diameter of said first chamber.

* * * * *

UNITED STATES PATENT AND TRADEMARK OFFICE

CERTIFICATE OF CORRECTION

PATENT NO. : 6,924,598 B2
DATED : August 2, 2005
INVENTOR(S) : Strattman

It is certified that error appears in the above-identified patent and that said Letters Patent is hereby corrected as shown below:

Column 8,
Line 18, after "and", insert -- capable of --.

Column 9,
Line 19, delete "to said first chamber".

Signed and Sealed this

Twenty-fifth Day of April, 2006

JON W. DUDAS
*Director of the United States Patent and Trademark Office*